US005325162A

United States Patent [19]

Kroll et al.

[11] Patent Number: 5,325,162

[45] Date of Patent: Jun. 28, 1994

[54] COLOR IMAGE FORMING APPARATUS AND TONER CONTAINER

[75] Inventors: Arthur S. Kroll, Rochester; Michael L. DeCecca, Fairport; Arthur E. Dunn, Rochester; Jerry E. Livadas, Webster, all of N.Y.

[73] Assignee: Eastman Kodak Company, Rochester, N.Y.

[21] Appl. No.: 897,714

[22] Filed: Jun. 12, 1992

Related U.S. Application Data

[63] Continuation of Ser. No. 669,701, Mar. 15, 1991, abandoned.

[51] Int. Cl.[5] ..... G03G 15/06

[52] U.S. Cl. ..... 355/260; 118/645; 222/DIG. 1; 355/245; 355/326 R

[58] Field of Search ..... 355/326 R, 327, 245, 355/246, 260; 222/DIG. 1; 118/645, 653

[56] References Cited

U.S. PATENT DOCUMENTS 4,062,385 12/1977 Katusha et al. ..... 222/DIG. 1 X
4,878,091 10/1989 Morita et al. ..... 355/245 X
5,111,245 5/1992 DeCecca et al. ..... 355/245
5,150,162 9/1992 Saito ..... 355/260
5,172,165 12/1992 Hatakeyama et al. ..... 355/245 X
5,182,608 1/1993 Kroll et al. ..... 355/326
5,229,820 7/1993 McDougal et al. ..... 355/326 R X

FOREIGN PATENT DOCUMENTS 1-266566 10/1989 Japan .

*Primary Examiner*—A. T. Grimley
*Assistant Examiner*—Shuk Y. Lee
*Attorney, Agent, or Firm*—Leonard W. Treash, Jr.

[57] ABSTRACT

A toner container has three chambers for holding three different color toners. The container is receivable by a receiving structure having a pair of opposing slots for receiving flanges on the base of the toner container. The receiving mechanism is part of a development device which includes a movable carriage for moving a plurality of development units into alignment with a development position. A portion, for example, an applicator of each development unit is movable with respect to the rest of the unit into toning relation with an image member at the development position.

9 Claims, 8 Drawing Sheets

FIG. 3
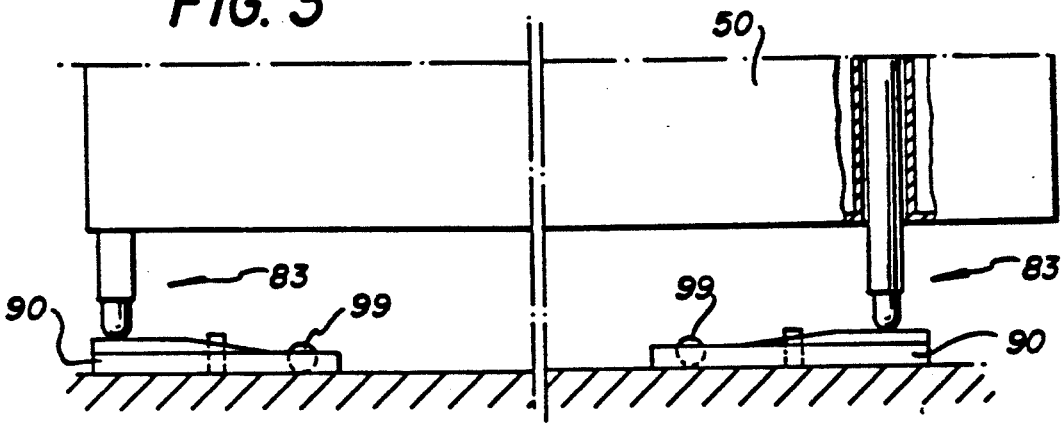
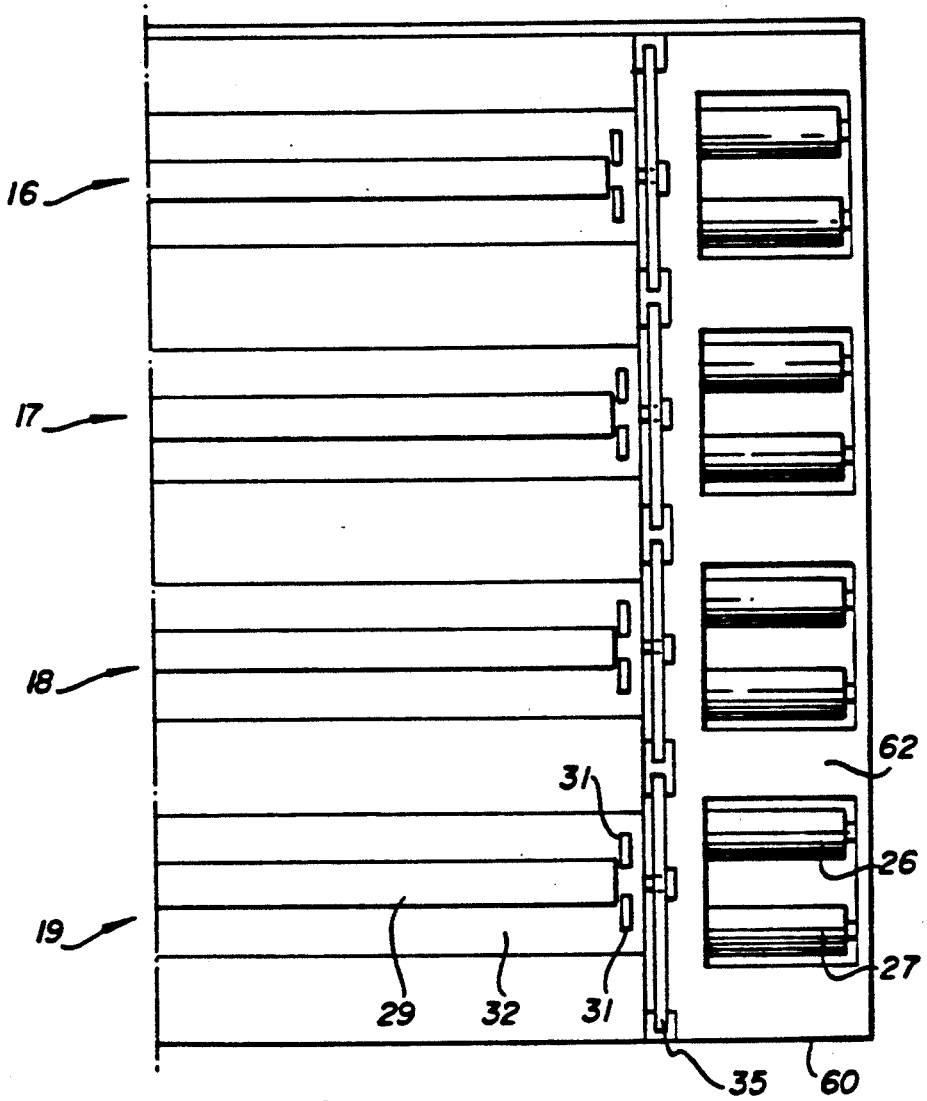
FIG. 5

COLOR IMAGE FORMING APPARATUS AND TONER CONTAINER

This is a continuation of application Ser. No. 669,701, filed Mar. 15, 1991, abandoned.

FIELD OF THE INVENTION

This invention relates to the development of electrostatic images. It is particularly useful in applying toners of different colors to a series of electrostatic images to create a series of different color toner images, It also relates to toner containers for supplying such toners to image-forming apparatus which create such different color toner images.

BACKGROUND ART

U.S. Pat. No. 4,928,146, issued to Yamada on May 22, 1990, is illustrative of a number of references which show the development of a series of electrostatic images carried on a photoconductive drum with different color toners at a single development position. A series of four development stations are moved one after another to the development position. Each station develops an image and is replaced by another station as the series of stations is indexed to apply a different color toner to the next image. The series of stations are arranged side-by-side and moved linearly through a position in which the station to be used is aligned with the development position. After or as it is aligned, a cam is rotated to push the entire station toward the development position, generally moving transverse to the motion of the series of stations and moving relative to the other stations.

This general approach has the advantage of using only a single development position for applying four different color toners to electrostatic images. This permits the use of development stations whose size and number would prohibit them being spaced around the periphery of a relatively small photoconductive drum. It, thus, also permits the use of a small photoconductive drum in multicolor imaging. The use of a small drum has many advantages, including reduced expense, reduced size of the apparatus and convenience in cartridge type replacement.

The structure shown in the prior art requires two motions on the part of each development unit. The four units are moved as one, linearly in one direction and the unit opposite the development position is moved relative to the others, transverse to that motion into operative relationship with the photoconductive drum. The second movement requires that the units be mounted so they are movable relative to each other and requires a separate moving mechanism that must be powered sufficiently to move an entire unit.

U.S. Pat. No. 5,182,608 to Kroll et al, issued Jan. 26, 1993, describes a structure which solves some of the problems associated with these prior art structures by providing a movable applicator at the top of each unit which is movable relative to the unit. With a movable applicator the rest of the unit can be fixed with respect to the other units and only the applicators moved for final positioning with respect to the development position. That application shows toner supply chambers positioned longitudinally between the units which supply chambers are either replaceable from above the units or fillable from above the units. Such chambers contain a limited amount of toner and generally would require complete removal of the developing device for replacement of toner. Toner could be supplied in four separate containers, as is generally the case for supplying toner to color electrophotographic apparatus.

U.S. Pat. No. 4,733,269, Kasahara et al, issued Mar. 22, 1988, shows a traditional container for supplying toner to an electrophotographic apparatus. The toner is contained in a plastic bottle having a generally rectangular cross-section with a base having flanges extending outward from opposite sides for inserting in slots in a receiving structure. Once the toner bottle has been positioned over a sump with the flanges held by the slots, a pull tab is pulled, removing a paper seal and opening the bottom, dumping the toner into the sump. The sump does not take all of the toner in the container, and the container, therefore, stays on top of the sump until empty, at which point it is removed and a new toner container positioned. The container, thus, forms a portion of the toner supply system of the apparatus. It extends as far above the sump as the apparatus will permit to hold as much as two liters of toner.

U.S. Pat. No. 4,899,690, Hacknauer etal, issued Feb. 13, 1990, shows a toner bottle similar to that in the Kasahara reference which is designed for a color apparatus which would receive four such bottles side-by-side on stationary sumps.

The packaging for such toner is a significant portion of the cost of supplying the toner. To multiply that packaging cost by four with a four-color image-forming apparatus is undesirable, but it is the present state of the art.

DISCLOSURE OF THE INVENTION

It is a first object of the invention to provide a toner container which reduces substantially the expense of supplying color toners to a color image-forming apparatus.

This first object is accomplished by a single toner container containing two or more toners of different color. With this structure, substantial packaging costs can be saved in supplying color toners to a color image-forming apparatus.

In a typical image-forming apparatus using black, cyan, magenta and yellow toners, the black toner is used much more often than the other three. However, the other three toners are usually used in similar amounts. Thus, according to a preferred embodiment, the container has three compartments for containing toners other than black, and the black toner is supplied in a separate container which may be larger and/or may be replaced more often.

According to a further preferred embodiment, the first object is accomplished by providing a unitary toner container which includes means defining at least two, and preferably three or four, toner chambers alongside each other. The toner container contains means for positioning the toner container on a toner receiving apparatus and has at least two separate openings in the bottom of the container from which toner is supplied to at least two separate sumps arranged alongside each other on the toner receiving apparatus, e.g., a development device.

It is a second object of the invention to provide an efficient and space-saving approach to supplying toner to a development device of the type having four movable stations alongside each other.

This object is accomplished by an image-forming apparatus which includes a development device for applying different color toners to a series of electrostatic images carried on an image member to create a series of different color toner images as said electrostatic images move through a development position. The development device includes a movable carriage, a plurality of development units arranged in side-by-side relation and supported by the carriage and movable by said carriage in a generally linear direction through alignment with said development position. Each unit includes an applicator movable toward the development position with which it is aligned, to position the applicator in toning relation with an electrostatic image carried by the image member. The carriage includes means for receiving the toner containing means at an end of the units with said toner containing means movable with the carriage. Means are associated with each development unit for receiving toner from a toner container means so received, said received toner containers moving with the carriage in its generally linear movement but not moving with the applicators as they move relative to the carriage.

With this type of a toner receiving apparatus toner containers can be used which extend substantially above the position of the applicators and hold substantially more toner than if placed in each unit.

The feature of moving the applicator with respect to the rest of the unit contributes substantially to the design of such an apparatus, since the toner containers then do not have to be raised with the development units in positioning the applicator with respect to the image position. This last feature also contributes to the use of a single package for these toners, since each of the compartments of such a package could not be moved relative the others.

BRIEF DESCRIPTION OF THE DRAWINGS

FIG. 3 is a right side view of the bottom portion of the development device shown in FIG. 2.

FIG. 5 is a top view of the development device shown in FIG. 4 with the sumps and toner containers eliminated for clarity of illustration.

BEST MODES FOR CARRYING OUT THE INVENTION

Figure 1:
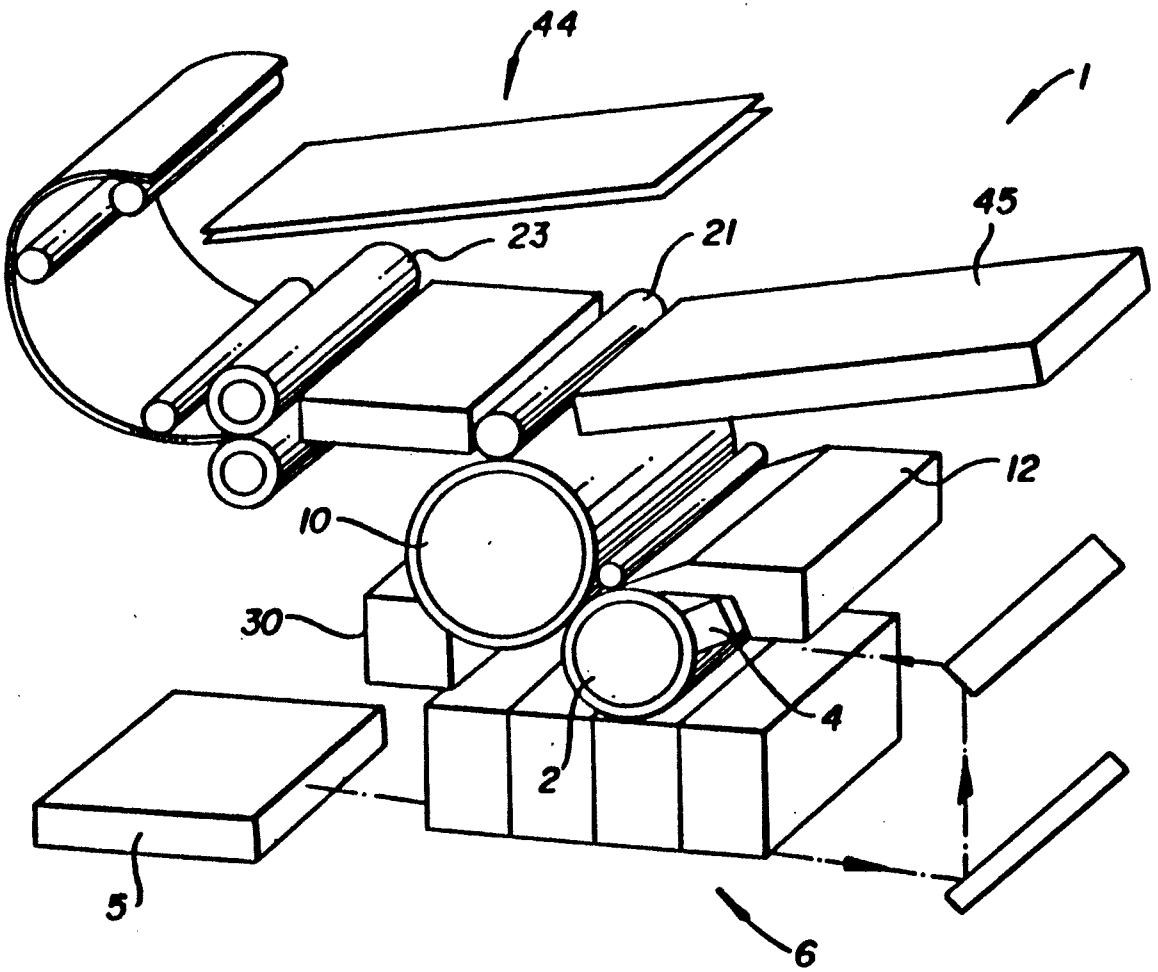
FIG. 1 is a perspective drawing of a color printer in which the invention is particularly useful. Many support structures are eliminated for clarity of illustration in showing the general relationship of the components.

The invention is particularly useful with or as part of an image-forming apparatus, for example, an electrophotographic printer i which is shown schematically in FIG. 1. According to FIG. 1, printer 1 includes an image member, for example, a photoconductive drum 2. Drum 2 is rotatable past a series of stations to form electrostatic images on an outer cylindrical surface. More specifically, drum 2 is rotated past a charging device 4 which places a uniform charge on its surface. It is imagewise exposed by a laser 5 to create a series of electrostatic images. The electrostatic images are toned by application of one of a plurality of different color toners by a development device 6 to create a series of different color toner images. The different color toner images are transferred in registration to a surface of a transfer drum 10 to create a multicolor image thereon. The multicolor image, in turn, is transferred to a receiving sheet fed from a receiving sheet supply 45 to a transfer station 21. The receiving sheet is then fed to a fuser 23 where the multicolor image is fixed, and the receiving sheet is finally deposited, after an inversion, in an output hopper with other sheets shown at 44. The transfer drum 10 is cleaned by an articulatable cleaning device 30, and the drum 2 is continually cleaned by a fixed cleaning device 12. Although not shown in FIG. 1, the image member 2, charger 4 and cleaning device 12 may be supplied to the printer 1 in a single image member cartridge. Transfer drum 10 can be driven by means, not shown, and drum 10 can, in turn, drive drum 2 through its operational cycle.

Facilitating compactness of the printer 1 and supply of the image member 2 in a cartridge, the image member 2 is quite small. This is possible because the image member has a single development position at which all toners are applied.

Figure 2:
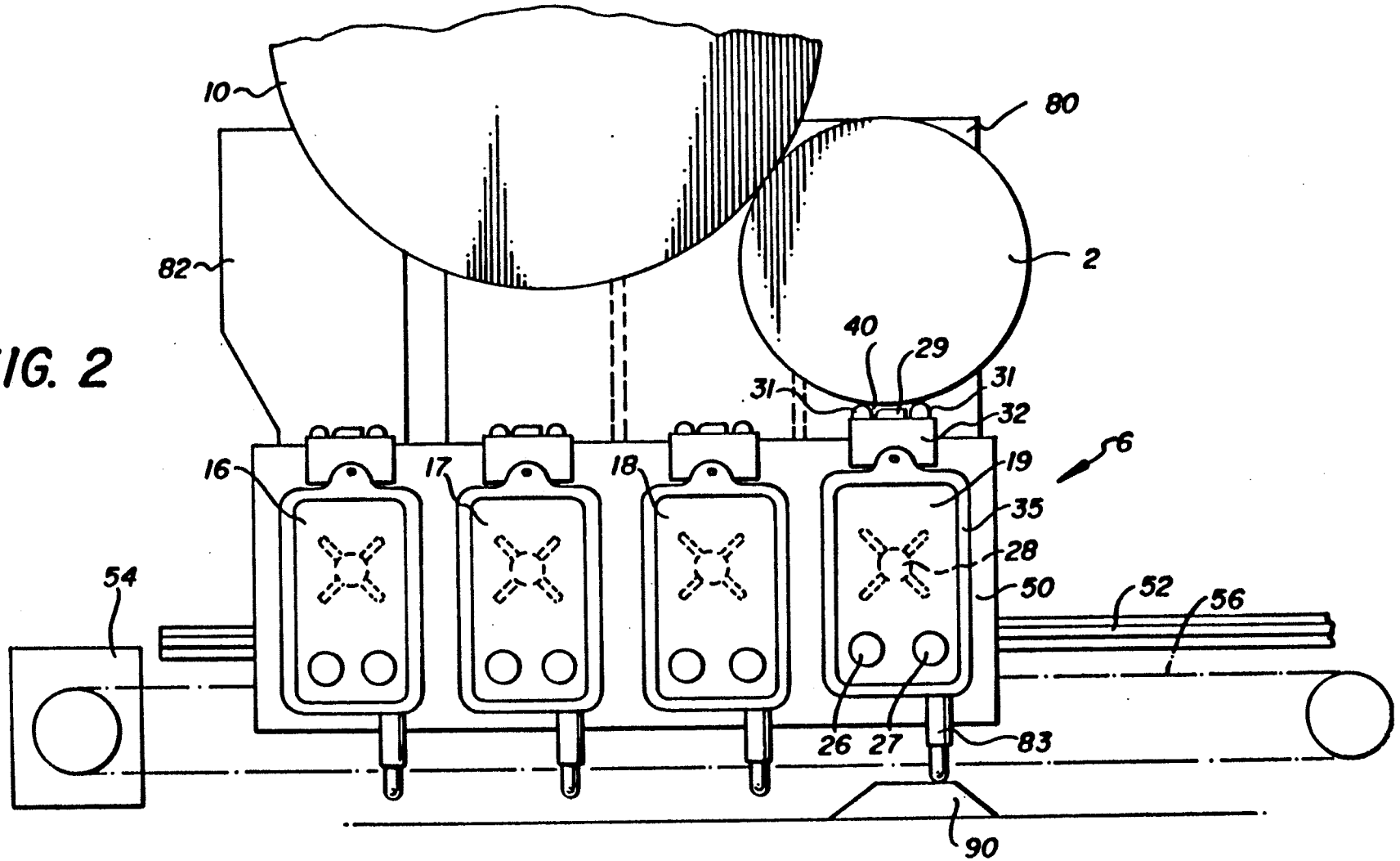
FIG. 2 is a front view with many parts eliminated for clarity of illustration of a development device usable in the printer shown in FIG. 1.

Referring to FIG. 2, development device 6 is illustrated. It is similar to a development device shown in U.S. Pat. No. 5,182,608, issued Jan. 26, 1993, to Kroll et al. The disclosure of that application is incorporated by reference herein.

According to FIG. 2 development device 6 includes four separate development units 16, 17, 18 and 19. Each development unit is of a type having a pair of augers 26 and 27 which mix two-component developer at the bottom of a developer chamber, not shown. In the middle of the chamber is a paddle 28 which raises the level of the developer bringing it into the magnetic influence of a magnetic applicator 29. Applicator 29 includes a rapidly rotatable magnetic core and a stationary shell. Rotation of the core causes two-component developer to move around the outside of the shell in a direction generally opposite to the direction of the rotation of the core. This action is facilitated by use of a carrier having a high coercivity. Similar development units are described in more detail in U.S. Pat. Nos. 4,922,302; 4,884,109; and 4,797,704, which can be referred to for more details.

Applicator 29 is precisely spaced from image member 2 by four small rollers 31. The rollers 31 and applicator 29 are supported by an applicator support 32 which is slidably movable in a vertical direction. Each of the units 16, 17, 18 and 19 are fixed in a carriage 50. Applicator support 32 is movable vertically with respect to carriage 50 by a pair of lifters 35 at opposite ends of carriage 50. Lifters 35 are controlled by a lifting pin 83 affixed to the bottom of lifter 35.

As a series of electrostatic images formed on the outside surface of image member 2 pass through a development position 40, the carriage 50 is moved from a position to the left of that shown in FIG. 2 to a position in which unit 19 is aligned with the development position 40. As part of that movement, pin 83 engages a ramp 90, also shown in FIG. 3. Pin 83 has a coil spring which is stressed by engagement with ramp 90 and urges lifter 35 in an upward direction. Lifter 35 raises applicator support 32 until rollers 31 engage image member 2 to position applicator 29 accurately with respect thereto. After an electrostatic image has been toned with toner of the color contained in unit 19, the carriage is moved further to the right until unit 18 is aligned with development position 40. The procedure is repeated also with units 17 and 16 to tone four consecutive images with different color toners. The carriage 50 is moved on rails 52 by a reversible motor 54 which drives carriage 50 through a tape drive 56.

In general, the structure has the advantage of requiring movement of only a portion of the development unit to position the applicator 29 accurately with respect to image member 2. It allows the rest of the development device 6 to be fixed with respect to carriage 50 thereby both saving space and reducing cost and weight. For more details of this structure, reference is made previously referred to Kroll et al U.S. Pat. No. 5,182,608.

Figure 4:
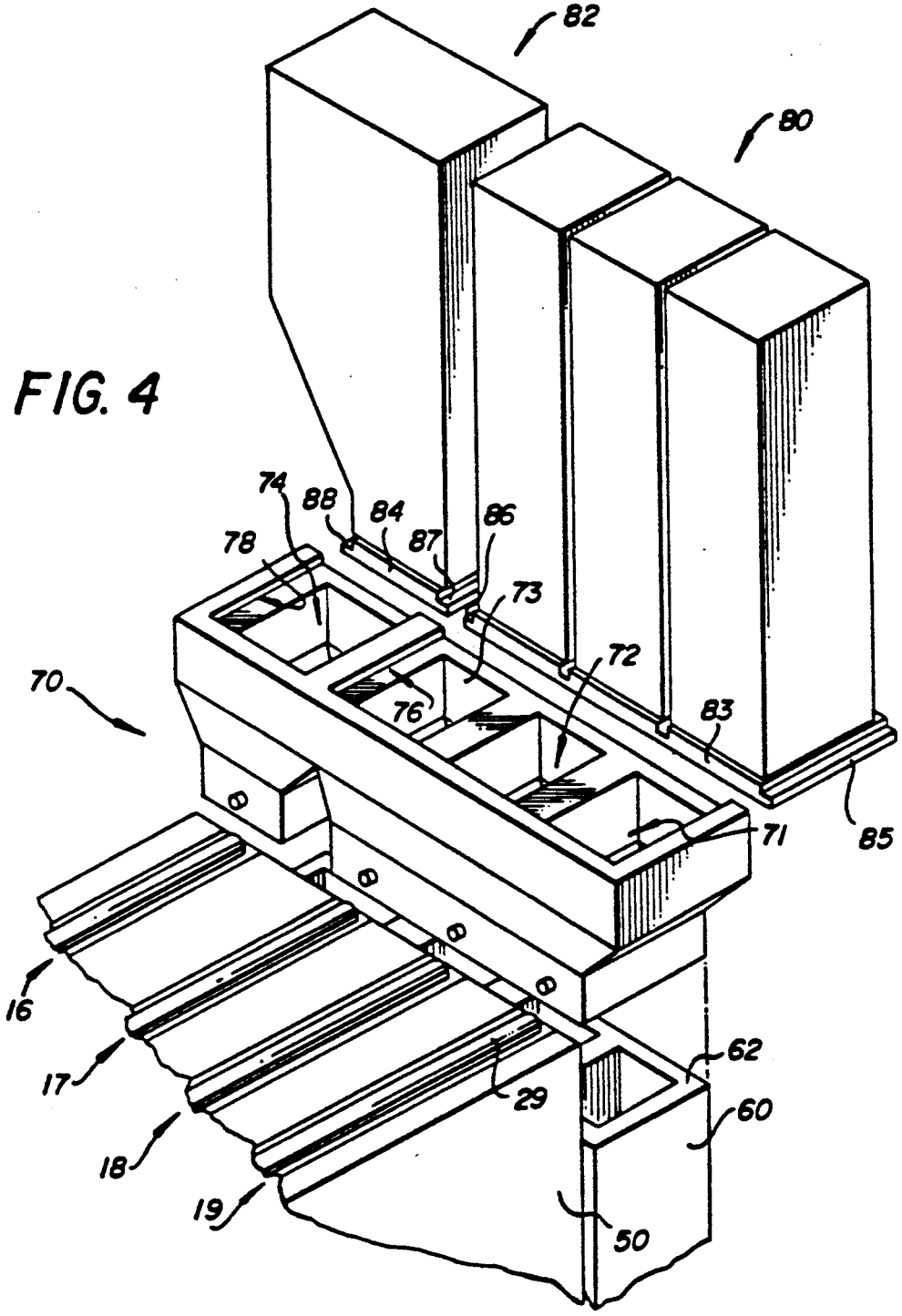
FIG. 4 is a perspective view of the back of a development device shown in FIG. 2 with receiving sumps for toner exploded upward and toner containers shown ready to be inserted onto the sumps.
Figure 6:
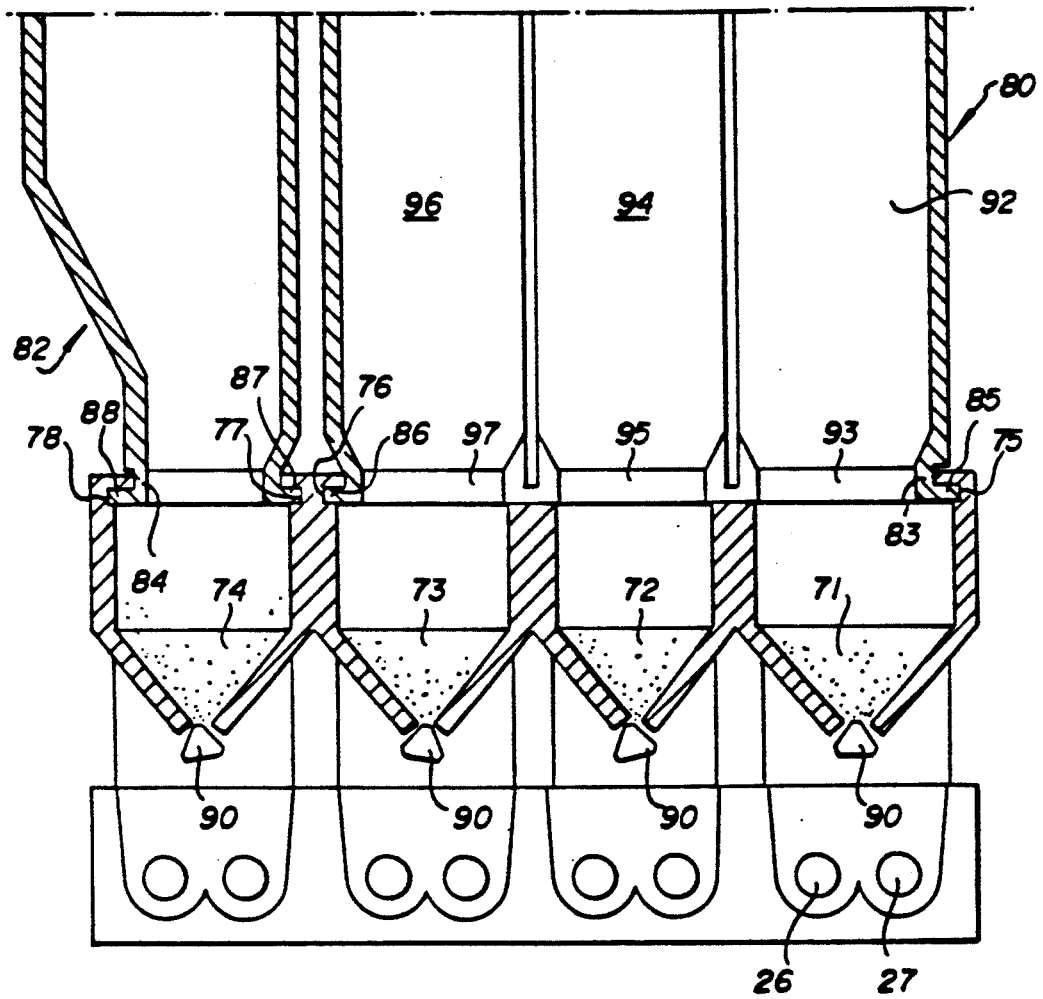
FIG. 6 is a front section through the toner containers toner sump and supporting portion of the development device shown in FIG. 4.

Another advantage of the structure shown in FIG. 2 is that toner can be supplied by substantial toner supply containers without raising and lowering the toner supply containers with the units. Referring to FIGS. 4, 5 and 6, the convenience of this toner supply capability is illustrated. Extended from the rear of carriage 50 is an extension 60 of carriage 50 with a flat top surface 62. As seen in FIG. 5, openings in surface 62 expose extensions of augers 26 and 27 in an extended portion of the development chamber of each of units 16, 17, 18 and 19. On top of surface 62 is positioned a single unitary sump assembly 70 which includes four separate toner sumps 71, 72, 73 and 74. The top of sump assembly 70 includes slots for receiving two toner containers 80 and 82. Slots 75 and 76 are positioned to receive a pair of flanges 85 and 86 at opposite ends of a base 83 for toner container 80. Slots 77 and 78 are positioned and shaped to receive a pair of flanges 87 and 88 on the base 84 of toner container 82.

Each of the bottoms of sumps 71, 72, 73 and 74 have slanted walls terminating in openings in which there is a toner supply roller 90 (FIG. 6). Toner supply rollers 90 are each rollers with flat sides at 120° spacings which fit in a snug bore having top and bottom elongated openings. They supply toner according to the number of revolutions they make. Each of the supply rollers 90 is separately actuable according to the need of its development unit either according to a set program, the sensing of a toner monitor or a monitoring of the use of that developing unit, all as is well known in the art.

Figure 9:
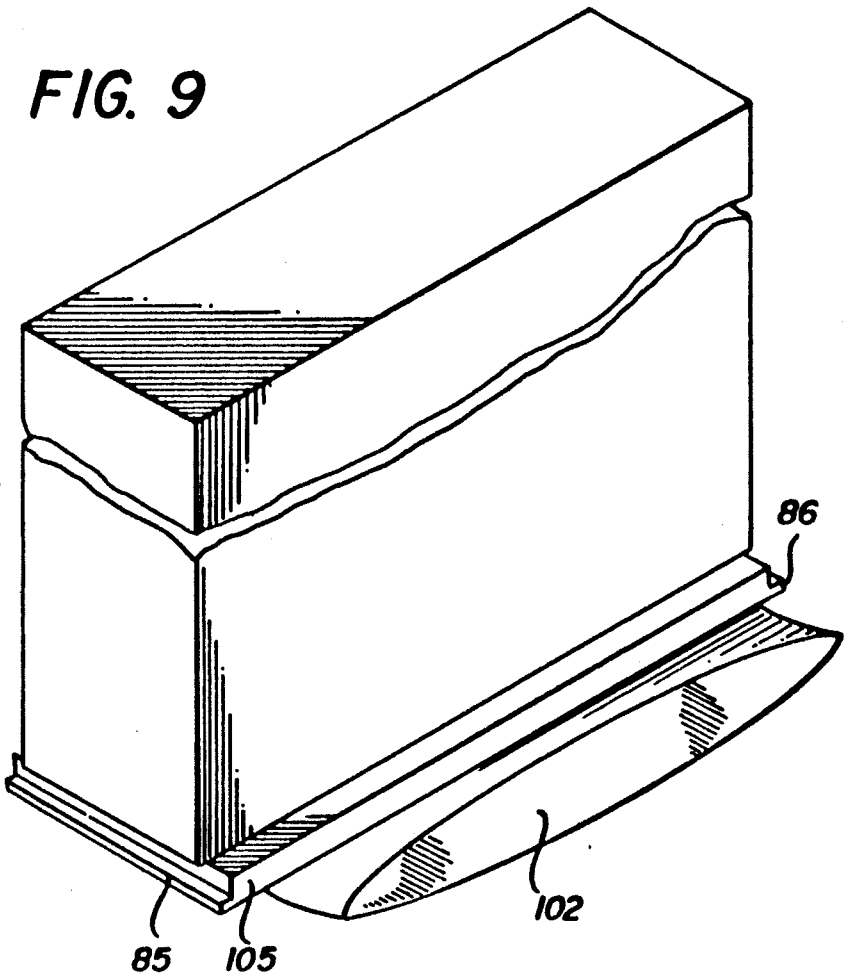
FIG. 9 is a perspective view of a toner container in a form alternative to that shown in FIG. 8.
Figure 8:
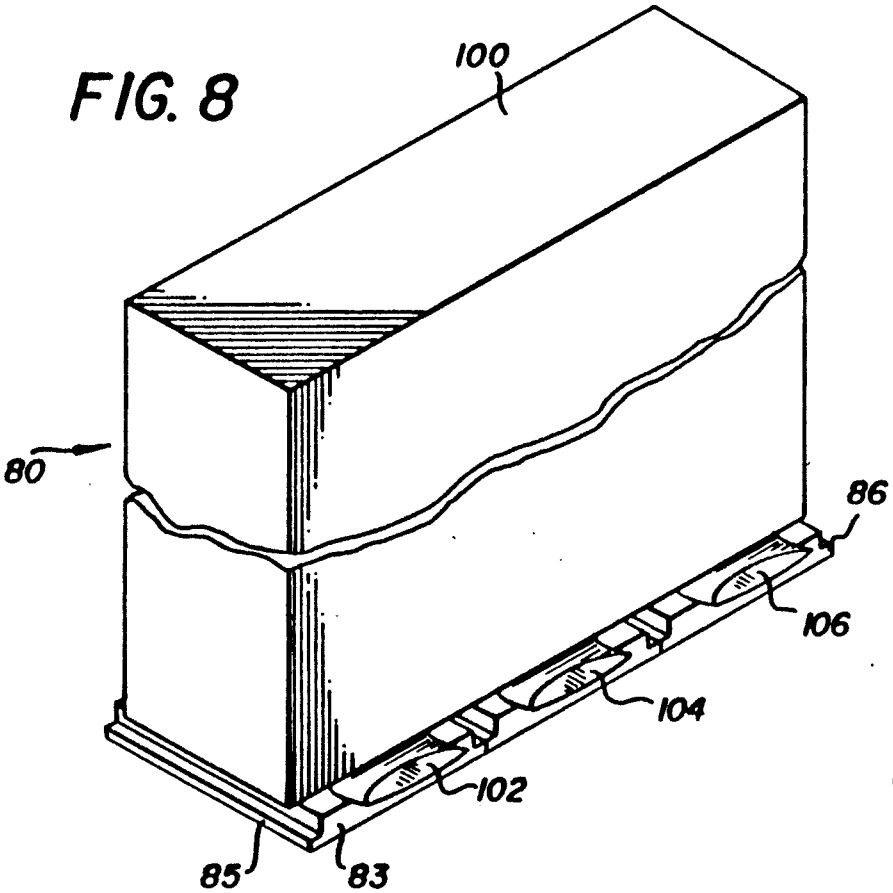
FIG. 8 is a perspective view of one form of a toner container also shown in FIGS. 2, 4, 6 and 7.

Toner container 80 is particularly advantageously constructed. It is formed of a unitary piece of plastic and contains three chambers 92, 94 and 96. Chambers 92, 94 and 96 terminate in openings 93, 95 and 97 in base 83. They are filled with different color toners, for example, cyan, magenta and yellow, which have a tendency to be used in the same amounts in full color apparatus. Alternatively, they may contain colors more commonly used for highlight imaging, for example, red, blue, brown or yellow. Having a single unitary container 80 not only saves in the manufacture of that container but in the space that must be taken up in its packaging and in the material used for packaging. FIGS. 8 and 9 show alternative forms of container 80. According to FIG. 8, container 80 has a three-part base 83 which is attached to a containing section 100, which containing section defines the three chambers 92, 94 and 96. The base 83 is separated from containing portion 100 by three tabs 102, 104 and 106 which are extended portions of a paper seal for the bottom of the chambers 92, 94 and 96 and extend across the top of openings 93, 95 and 97.

Alternatively, as shown in FIG. 9 a single tab 102 can be secured to the bottom of a single unitary base 105 in which are formed openings 93, 95 and 97.

Container 82 is conventional except that it has a larger chamber than any one of the chambers of container 80 and fits over the sump 74 for black toner. Depending upon usage in the machine, container 82, though having a larger capacity than the chambers 92, 94 or 96, may well have to be exchanged more often. For this reason, it is desirable that it be separate from container 80. However, as an alternative, a single container could be made holding four chambers for supplying all four colors to printer 1. Any of those chambers could be larger than another according to expected usage.

This feature of a three-chamber toner container is not limited to apparatus having a movable development device such as that shown in FIG. 2. Any place that three sumps can be positioned closely adjacent each other can make use of this cost, space and packaging saving feature. However, an advantage of the apparatus shown in FIG. 2 is that the development units 16–19 do not have to be movable with respect to each other. This feature facilitates use of a two or more chamber container.

Figure 11:
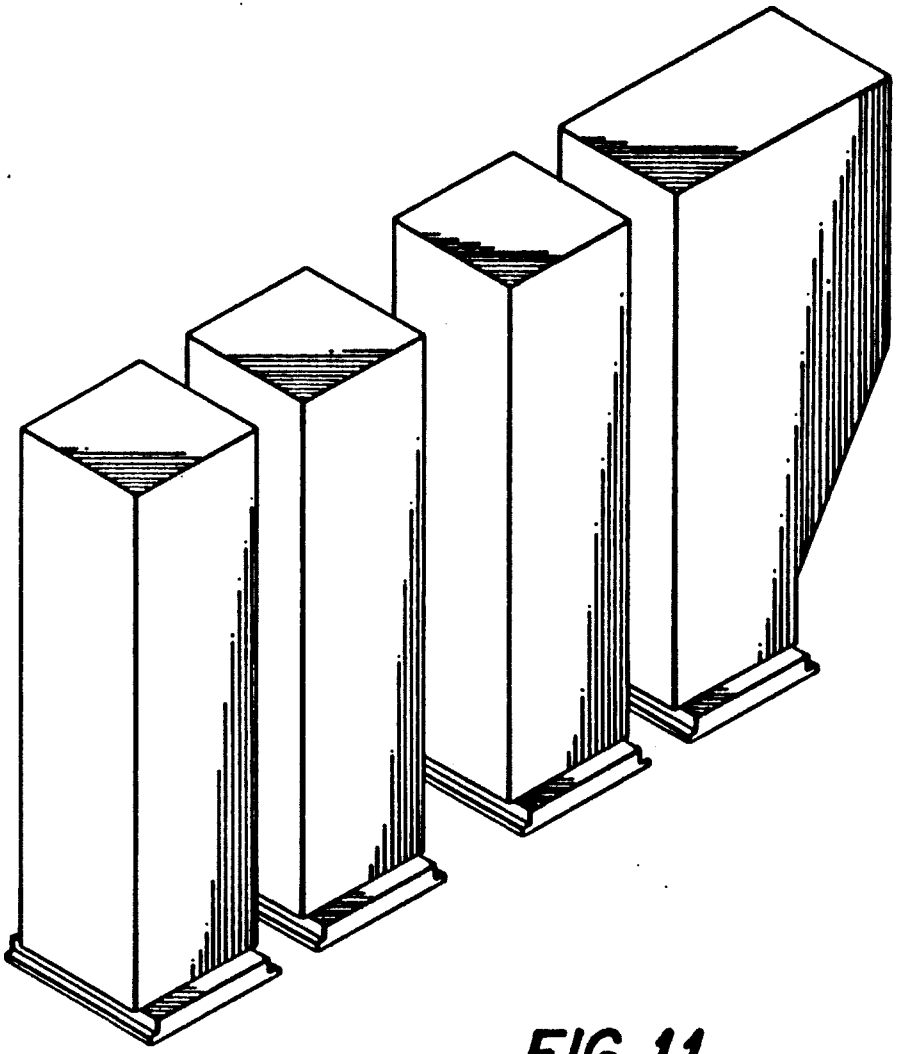
FIGS. 10 and 11 are perspective views of different toner-containing means which are alternatives to the forms shown in FIGS. 8 and 9 but which do not include some of the advantages of the structure shown in FIGS. 8 and 9, but which are also usable with the developing device shown in FIG. 2.
Figure 10:
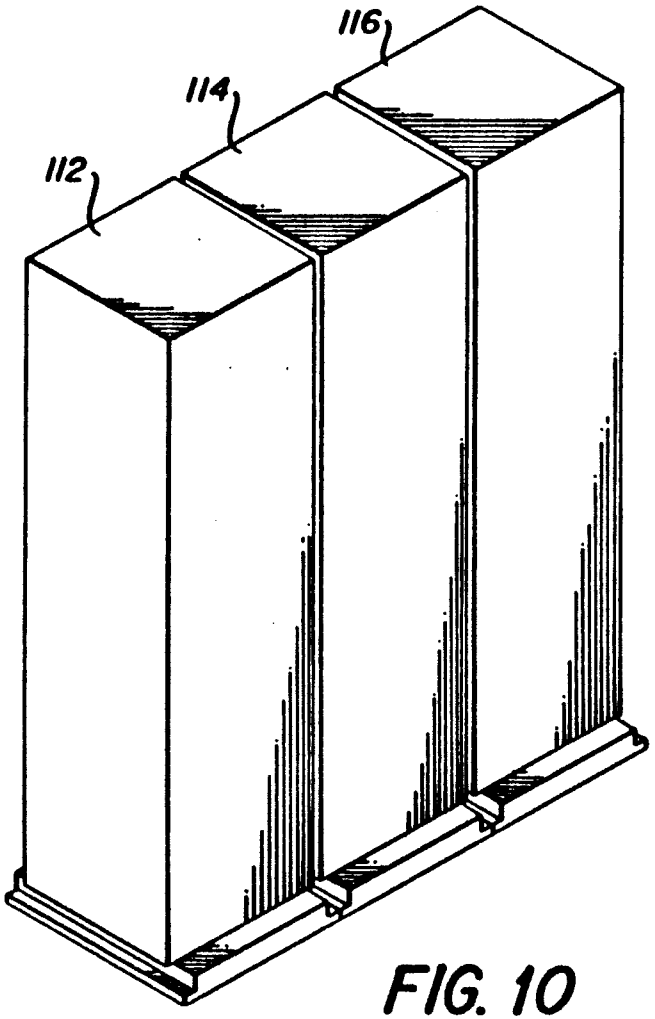

FIGS. 10 and 11 show alternative toner containers for the development device 6 shown in FIG. 2. According to FIG. 10 three toner containers 112, 114 and 116 are identically manufactured but with separate walls. They are positioned to adjoin each other and can be packaged together but then would be separable if one container was used considerably more than the other. They can be held together by a fracturable adhesive, a paper band or similar structure.

FIG. 11 shows four separate containers similar to those shown in FIG. 10 which could be separately packaged or packaged as a unit.

All of these structures shown in FIGS. 8–11 are usable with the apparatus shown in FIG. 2. However, the unitary structure shown in FIGS. 8 and 9 have the cost advantages of a single unitary container. The structure shown in FIG. 10, like that of FIGS. 8 and 9, permits saving in packaging.

Figure 7:
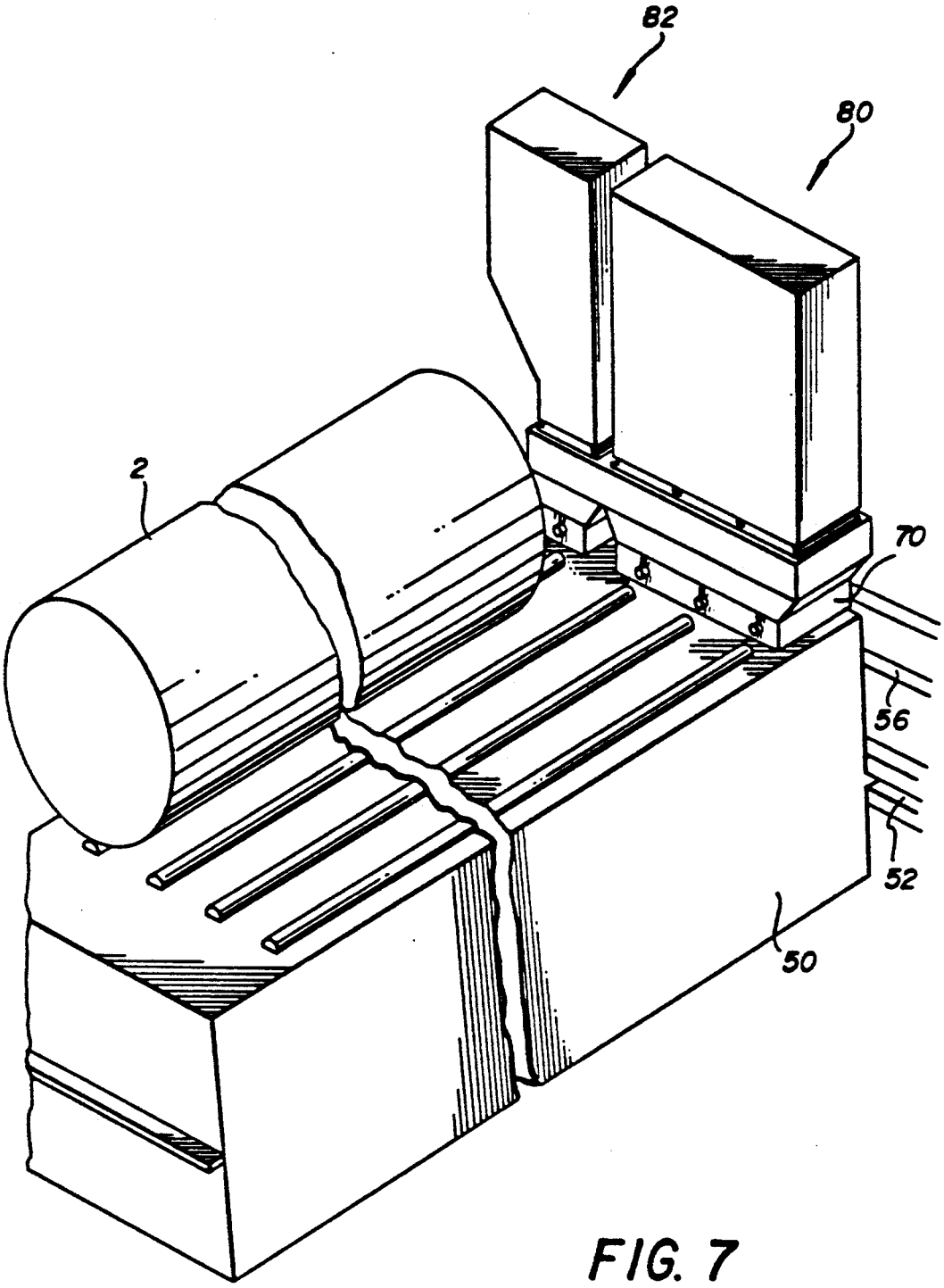
FIG. 7 is a perspective view of an alternative embodiment of the development device shown in FIG. 4 with the toner sump and toner containers in position on the development device.

FIG. 7 shows a slightly different embodiment from that of FIG. 4, in which the sump assemblies 70 are positioned on top of a top surface of carriage 50. This embodiment also illustrates the relationship of the carriage 50 and the toner containers with image member 2 in operation. It illustrates that the toner containers extend above the drum 2 as they pass to the rear of it (also seen in FIG. 2), as the carriage 50 moves to align the development units with the development position 40.

The invention has been described in detail with particular reference to a preferred embodiment thereof, but it will be understood that variations and modifications can be effected within the spirit and scope of the invention as described hereinabove and as defined in the appended claims.

We claim:

1. A development device for applying different color toners to electrostatic images carried on an image member as said electrostatic images are moved through a development position, said development device comprising:

a movable carriage, a plurality of developing units arranged in side-by-side relation and supported by said carriage, and movable by said carriage through alignment with said development position, each unit including an applicator movable toward said development position when aligned therewith to position said applicator in toning relation with an electrostatic image carried by said image member, and means supported by said carriage, for receiving toner container means at an end of said developing units, means associated with each developing unit for receiving toner from a toner container means so received, said means for receiving the toner container means being movable with said carriage but not movable with said applicator when said applicator moves toward said development position and said means for receiving toner container means including means for receiving a single unitary container containing a plurality of toners in a plurality of chambers, respectively.

2. A development device according to claim 1 wherein said receiving means includes a plurality of toner sumps arranged in aligned side-by-side relation with openings at the tops of the sumps and wherein said receiving means includes means for receiving said single unitary container on the tops of said openings with each of said chambers over a respective opening.

3. A development device according to claim 1 wherein said receiving means includes means defining a plurality of aligned toner sumps, a top surface adjacent said sumps and means defining opposing slots facing each other with said plurality of sumps between said slots, said slots being positioned to receive flanges of a unitary toner container in a position over said plurality of sumps.

4. A development device for applying different color toners to a series of electrostatic images carried on an image member, said development device including:

means for receiving a unitary toner container having a plurality of chambers, each chamber containing a toner of color different from the other chambers, said receiving means including a plurality of aligned toner sumps, a top surface adjacent said sumps, and means for defining opposing slots facing each other with said plurality of sumps between said slots, said slots being positioned and shaped to receive flanges of such a unitary toner container as said toner container fits over said plurality of sumps.

5. A toner container suitable for insertion into an image forming apparatus to replenish toner used by the apparatus, said container comprising:

means defining at least first and second chambers, positioned alongside each other and containing toners of first and second colors, means for attaching said container to a receiving apparatus with the chambers in a predetermined orientation, the chambers having a bottom when in the predetermined orientation, means defining openings to said chambers at the bottom of said chambers, and openable means closing said openings.

6. A toner container according to claim 5 including a base, said base including means defining said at least first and second openings and a pair of oppositely facing flanges positioned on opposite sides of said openings and extending away from said openings.

7. A toner container suitable for insertion into an image forming apparatus to replenish toner used by the apparatus, said container comprising:

means defining at least first, second and third aligned chambers positioned alongside each other and containing toners of first, second and third colors, means for attaching said container to a receiving apparatus with the chambers in a predetermined orientation, the chambers having a bottom when in the predetermined orientation, means defining openings to each of said chambers at the bottom of said chambers, and openable mean closing said openings to contain said toners therein.

8. A toner container according to claim 5 wherein said means closing said openings includes a plurality of web seals, each having a tab graspable by an operator for removing said seal, there being a separate seal for each of said openings.

9. The device according to claim 1 wherein the means for receiving the toner container is positioned to receive a container directly above the means for receiving toner, to permit supply of toner from a received container to each developing unit by gravity.

* * * * *